United States Patent [19]

Woodings

[11] Patent Number: 4,468,261

[45] Date of Patent: Aug. 28, 1984

[54] METHOD OF NORMALIZING SUCKER RODS USING A NORMALIZING UNLOADER

[76] Inventor: Robert T. Woodings, Box W, Mars, Pa. 16046

[21] Appl. No.: 371,582

[22] Filed: Apr. 26, 1982

[51] Int. Cl.[3] ..... C21D 1/28

[52] U.S. Cl. ..... 148/154; 148/155; 266/259

[58] Field of Search ..... 148/150, 154, 153, 155, 148/156, 157, 143; 266/92, 93, 46, 259

[56] References Cited

U.S. PATENT DOCUMENTS

| | | | |
|---|---|---|---|
| 3,489,620 | 1/1970 | Current | 148/150 |
| 3,682,721 | 8/1972 | Seulen et al. | 148/154 |
| 3,852,989 | 12/1974 | Harada et al. | 72/201 |
| 4,001,054 | 1/1977 | Makepeace | 148/16.5 |
| 4,068,516 | 1/1978 | Wonisch | 72/201 |
| 4,215,855 | 8/1980 | Zacharias | 266/259 |

FOREIGN PATENT DOCUMENTS

| | | | |
|---|---|---|---|
| 1020369 | 2/1966 | United Kingdom | 266/259 |

*Primary Examiner*—L. Dewayne Rutledge
*Assistant Examiner*—Christopher W. Brody
*Attorney, Agent, or Firm*—Thomas H. Murray; Clifford A. Poff

[57] ABSTRACT

An apparatus and method are provided for receiving sucker rods as they emerge from an electric-induction normalizing furnace and conveying them to a cooling bed while both suitably supporting and suitably rotating them to prevent warpage.

5 Claims, 4 Drawing Figures

METHOD OF NORMALIZING SUCKER RODS USING A NORMALIZING UNLOADER

BACKGROUND OF THE INVENTION

1. Field of the Invention

This invention relates to the manufacture of sucker rods for use in the oil industry, and in particular, it relates to a novel apparatus and method which are useful when such sucker rods are being manufactured with the use of an induction normalizing heat-treating step of the kind disclosed in my co-pending application Ser. No. 306,885, filed Sept. 30, 1981, now abandoned.

2. Description of the Prior Art

The general outline of the process of making sucker rods for use in the oil industry is familiar to those skilled in the art. Rod stock received from the steel manufacturer is straightened, the ends of the rods are heated to a forging temperature, the ends are forged to produce the usual features required at the ends of a sucker rod (such as the elevator button, the wrench square, and the pins), the forged rods are heat-treated, and the threads are rolled onto the pins. In the above-mentioned heat-treating step, the steel is sometimes heated to an austenitizing temperature, quenched and tempered; in some other instances, the treatment is normalizing, i.e., heating to approximately 1650° F., followed by cooling in still air. In any event, in accordance with the methods used before the invention of the above-mentioned pending patent application Ser. No. 306,885, the heat treatment was done with the use of a gas-fired furnace. The above-mentioned patent application teaches normalizing with the use of an induction furnace operating at a frequency of 7500 to 10,000 hertz.

Those skilled in the art of making sucker rods have not, as indicated above, ordinarily been required to confront the problems which attend the operation of receiving and permitting to cool in air the hot rods emerging from the electric induction furnace which is employed in connection with the method of the above-mentioned co-pending application.

One of the problems, in such an operation, is that the rods tend to warp during their cooling unless they are nearly continuously kept turning. Another problem is that it is necessary to keep the rods supported so that they will remain straight. It is desirable to have equipment so that this may be done with a minimum of labor.

SUMMARY OF THE INVENTION

Equipment for handling sucker rods delivered from an induction normalizing furnace comprises a first bed provided by a plurality of shafts having rollers mounted on them, the shafts being at an angle with respect to the direction of the delivery of the sucker rods as they emerge from the induction normalizing furnace, a drive means for the shafts, a track perpendicular to the route of advance of the rods, support means mounted for movement along the track, and means to advance, retract, raise, and lower the support means. Desirably, the equipment also includes a limit switch for detecting when the rods become fully advanced, and means responsive thereto for raising and advancing and then lowering the support means, to deliver the sucker rods to a second bed, upon which they are simultaneously turned and permitted to cool in air.

BRIEF DESCRIPTION OF THE DRAWINGS

A complete understanding of the invention may be obtained from the foregoing and following description thereof, taken in connection with the accompanying drawings, in which.

DESCRIPTION OF THE PREFERRED EMBODIMENT

Figure 1:
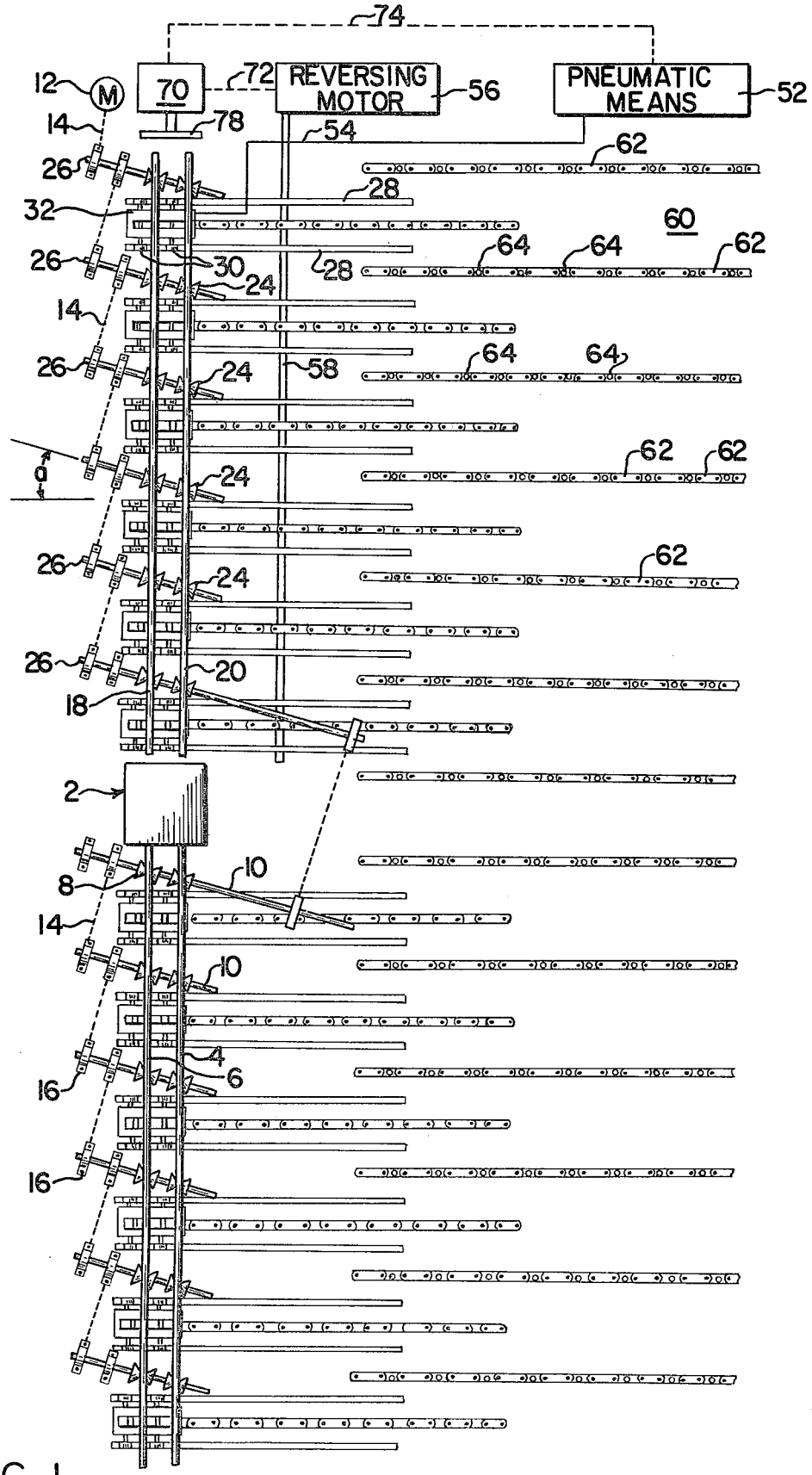
FIG. 1 is an overall plan view, partly diagrammatic, illustrating equipment of the invention for use and practicing the method of the invention.

In the drawings, there is indicated an electric induction furnace 2, which may be of the kind described in my co-pending application Ser. No. 306,885, filed Sept. 30, 1981. Rods 4, 6 which are about to be delivered to furnace 2 rest upon rollers 8 mounted on the shafts 10, which are driven by a motor 12 through chains 14 and sprockets 16. Additional sucker rods 18, 20 are shown on the delivery side 22 of the furnace 2, and these are likewise mounted on rollers or sheaves 24 carried by the shafts 26, which are journaled for rotation by means not shown and, like the shafts 10, set at an angle $\alpha$ with respect to the route or direction of advance of the rods 18, 20. As a typical operating condition, the motor 12 causes the rods 18, 20 to advance at a suitably slow rate of speed, such as 10 to 20 feet per minute, preferably about 17 feet per minute, and when the angle $\alpha$ is on the order of 5° to 15°, the sucker rods 18, 20 are also caused to revolve at a suitable rate of speed, such as 3 to 15 revolutions per minute.

Figure 2:
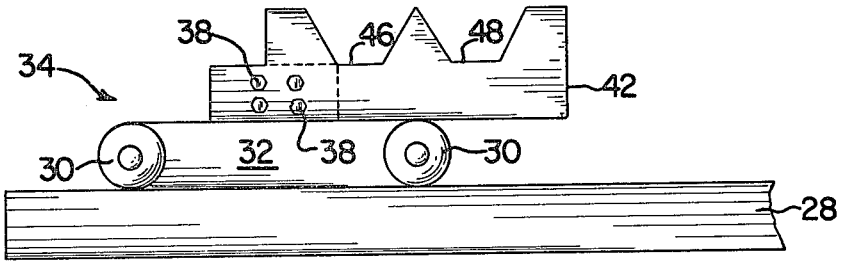
FIG. 2 is an elevational view of a portion of the apparatus indicated in FIG. 1, with the support means in the lowered position.
Figure 3:
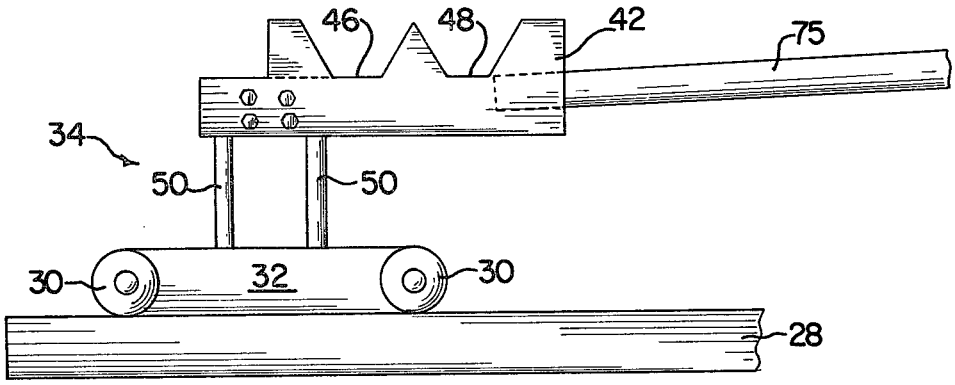
FIG. 3 is likewise an elevational view of a portion of the apparatus shown in FIG. 1, with the support means in the raised position.

Set beneath the level of the rods 18, 20 there are tracks or rails 28, which receive the wheels 30 of a carriage 32 which form a part of the support means 34, shown in FIGS. 2 and 3.

Figure 4:
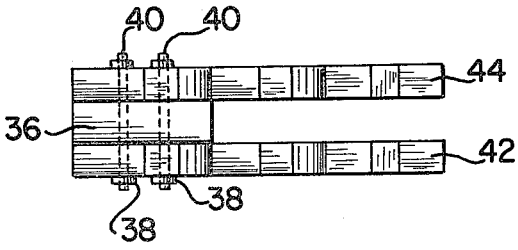
FIG. 4 is a plan view of the portion of the apparatus shown in FIG. 3.

As shown in FIG. 4, the support means 34 comprises a block 36 to which there are secured as by means of bolts 38 and 40, arms 42, 44 which contain recesses 46, 48 (best seen in FIGS. 2 and 3) which are adapted to receive the rods 18, 20. As will be seen by comparison of FIGS. 2 and 3, the block 36 may be raised from a lowered position, as shown in FIG. 2, to a raised position, as shown in FIG. 3, by means of support columns 50. Pneumatic means 52 operate through a line 54 to cause raising and/or lowering of the arms 42, 44.

The equipment further includes a reversing motor 56 having an output shaft 58, which works through a chain 60 to advance, when desired, the carriage 32 from its position under the rods 18, 20 as they are delivered from the furnace 2 to a position adjacent a cooling bed 60, which is comprised of a number of parallel chains 62, suitably driven by means, not shown. There is mounted on the chain 62 a number of upstanding nubs 64, which are so aligned to provide spaced, separate support for sucker rods such as the rods 18, 20 after they have been moved from their position in alignment with the path of travel through the furnace 2 to the cooling bed 60.

Optionally, but preferably, the equipment further comprises a stop means 70 which is operatively connected as at 72 to the reversing motor 56 and as at 74 to the pneumatic means 52, in order that the operation of using the supports 34 to deliver sucker rods to the cooling bins may be made automatic.

In addition to the tracks or rails 28 upon which the various carriages 32 run, there are also tracks or rails 75 (not shown in FIG. 1, in the interest of simplicity, but particularly indicated in FIG. 3) which are suitably spaced all along the length of the sucker rods to be transported to the cooling bed 60. These rails 75 preferably extend away from the cooling bed 60 for such a distance and are at such an elevation that substantially as soon as the carriage 32 begins to move towards the cooling bed, the sucker rods in the recesses 46, 48 will begin to come into contact with the rails 75 and be rolled therealong, pushed by the arms 42, 44 attached to the carriage 32. It is important to use a plurality of tracks 75 so spaced along the length of the sucker rods as to prevent any substantial sagging. Ordinarily, it will be advisable to use at least six sets of tracks or rails 75 to support sucker rods having an overall length of 25 feet. It will also be apparent that the rails 75 do not extend away from the cooling bed for such a distance as to prevent the arms 42, 44 from raising the sucker rods 18, 20 before the carriage 32 begins to advance from its initial rod-receiving position toward its rod-delivery position adjacent the cooling bed 60. In a portion of them which is adjacent the path of travel of the rods 18, 20 through the furnace 2 and remote from the cooling bed 60, the rails 75 are preferably slightly inclined upwardly from the horizontal as one moves along them in the direction of the cooling bed 60; this has the effect that as the carriages 32 move towards the bed 60, the onset or beginning of having the rods supported upon the rails 75 is smooth and gradual, rather than being abrupt as it would be if a rod being moved towards the bed 60 were to be caused to encounter a rail 75 whose top or support surface were at an elevation a few millimeters above that of the portion of the conveyed rod initially brought into contact therewith. In other words, it is desirable to avoid shocking or joggling the rod as it comes into contact with the rails 75. The same is true also at the other end of the rails 75, i.e., the end nearest the cooling bed 60. There, it is desirable that the top or support surfaces of the rails 75 be inclined slightly downwardly with respect to the horizontal as one moves toward the bed 60. Whether or not the rails 75 have a central portion wherein their top or support surfaces are horizontal is a matter of choice. To insure adequate prevention of sagging, it is desirable to use as many as eight to twelve of such rail means 75 to support a rod having an overall length of 25 feet, and although there is no absolutely necessary connection between them, an approximately equal number of pairs of track means 28 and carriages 32. The total number, of course, is not as important as the maximum spacing between them along the length of the rod.

In a manual mode of operation, the equipment indicated above is operated in the following manner. The motor 12 runs continuously, causing rods such as the rods 4, 6 to be delivered into and through the furnace 2 and emerge therefrom, constantly being rotated and conveyed forward until they assume a position such as that shown in FIG. 1 for the rods 18, 20. If necessary, an operator grasps one of the rods 18, 20 which has lagged somewhat behind the other in its being conveyed along the route formed by the rollers 24. At a suitable time, the operator moves to activate the pneumatic means 52 to cause the arms 42, 44 in the various support devices 34 along the length of the rod to be raised. The operator then activates the reversing motor 56 to cause the carriage 32 to move to a position adjacent the bed 60. This causes the rods to be brought into contact with the tops or support surfaces of the rails 75 and then, as the carriage 32 continues to move towards the bed 60, it causes the rods to be pushed and rolled along the rails 75 during their time of transit to the vicinity of the bed 60. As has been indicated above, it is desirable for the rails 75 in the vicinity of the cooling bed 60 to be inclined somewhat downwardly with respect to the horizontal, and during the passage of the rods over those portions of the rails 75, the function of the recesses 46, 48 is to retard the rods as they roll along the rails 75, rather than pushing them along. Then the arms 42, 44 are lowered, and the carriage 32 is retracted to its original position. This causes the rods to be delivered so that they lie between a set of nubs 64 on the chain 62 forming the bed 60. It is to be understood that the spacing between the recesses 46, 48 corresponds to the distance between the rods 18, 20 as they emerge from furnace 2, and also to the spacing between the nubs 64 on the chain 62 comprising the bed 60.

In a more highly automated mode of operation the sucker rods 18, 20 advance until they encounter the portion 78 of the stop means 70, by which they are evened. The stop means 70 then operates, by suitable programming, to bring about a suitably timed raising and lowering of the arms 42, 44 and advancing and retracting of the carriages 32, to effect the same motion of the rods 18, 20 to the bed 60.

In its method aspects, the present invention involves a series of steps which are applied to the sucker rods to cause them to become appropriately heat-treated while preserving suitably their physical form, these steps being ones which are, according to my present knowledge, most advantageously performed by means of the use, with properly selected operating conditions, of apparatus of the kind herein disclosed and taught. Sucker rods having suitably forged ends are subjected to a normalizing heat treatment by being passed through an electric induction normalizing furnace whereby the rods are heated to a normalizing temperature, such as approximately 1650° F. In their heated condition, the rods have a very greatly diminished physical strength, i.e., they are, while glowing hot, prone to sagging unless properly supported at various suitably closely-spaced locations, and they are also, while so heated, in need of being protected from gravitational influences which might otherwise cause them either to become further elongated or to become shortened as a result of their own weight; this implies that the processing is desirably to be done while maintaining the rods at substantially all times as nearly horizontal as is practicable, while providing also as aforementioned a suitably closely-spaced plurality of points of support. There is also operating at the same time the need for arranging, preferably as nearly continuously as is practicable, for the continued rotation of the rods about their longitudinal axes as a way of preventing warpage or deformation of the rods as they cool in the air from the above-mentioned normalizing temperature. The equipment of the kind disclosed herein is particularly suitable for use in achieving these objectives. It is to be understood that in accordance with the invention, the equipment or apparatus as described above is also to be used with the observance of particular operating parameters. Thus, the sucker rods having ends forged thereon are heated in an electrical-induction normalizing furnace through which they travel in a substantially horizontal orientation, the furnace comprising at least three and possibly four or five or more induction coils, which are powered with alternating electric current at a frequency which may vary within the range of approximately 3000 to 10,000 hertz and with a power of about 400 to 800 kilowatts. More particularly, for the processing of rods 25 feet long and with a diameter of about $\frac{5}{8}$ to $1\frac{1}{8}$ inches, and with a line speed on the order of 10 to 20 feet per minute, preferably about 17 feet per minute, satisfactory results are obtained with the use of a frequency of 7500 to 10,000 hertz and a power of 500 to 800 kilowatts. As those familiar with electric-induction heating are aware, there is a tendency with the use of higher frequencies for the heat which is generated to be a greater extent localized in the vicinity of the exterior of the object subjected to electrical-induction heating. For some purposes, it may prove desirable, especially for purposes of providing heat by electrical induction to the forged ends of the rod, which are of somewhat increased diameter in comparison with the remainder thereof, to power some of the coils with alternating current of a lower frequency, such as 3000 or 4000 hertz. Those skilled in the art will appreciate the various trade-offs which operate in connection with the selection of operating conditions for the practice of the method of the invention. The use of greater electrical power will accelerate the heating operation and thus, within limits, improve the throughput of equipment which has been built on a given scale and with a capital investment of a given size, but with the concomitant drawback of higher ongoing operating costs for electric power. The expression "within limits" is used advisedly, because the entire process of converting rod stock to finished sucker rods can proceed no faster than the capacity rate of the slowest stage in the overall production operation. The use of greater numbers of coils in the heating operation lends flexibility to the operation, but usually increases the capital cost of an installation of a given size and scale. The operation may be, as desired, more or less highly automated, with familiar effects upon the labor operating expense and the initial investment required.

Particular mention deserves to be made of the importance of using rail means or the like, whereby provision is made for the continued rotation of the rods as they are being simultaneously cooled and transported from a first position in alignment with the induction normalizing furnace and a second position adjacent the cooling bed 60. This operation takes only a relatively short period of time, on the order of about five seconds, but it the rotation were to be stopped for even that relatively brief period of time, unacceptable deformation of at least some substantial portion of the rods being processed could be expected to occur.

The invention has been illustrated with respect to an embodiment wherein the sucker rods are passed through the induction normalizing furnace two at a time. It will be apparent to those skilled in the art that this could be changed. The forged sucker rods can be normalized one at a time or three or more at a time, as long as appropriate changes are made in the equipment employed and the practices that are used in operating that equipment.

For example, if there is only one rod normalized at one time, the equipment can be somewhat simpler, in that the arms 42, 44 then require only a single one of the recesses 46, 48. To maintain the same level of production in rods per hour, it is necessary for the single rods to pass through the furnace 2 at a greater line speed, such as 30 feet per minute instead of 15 feet per minute. This implies a disadvantageous use of more electrical power for both the heating of the sucker rods as they pass through the furnace 2 and for the conveying of them along their path of travel through the furnace. Moreover, all of the carriages 32 go through about 120 cycles of conveying per hour, instead of merely 60.

On the other hand, if sucker rods are induction-heated three at a time, corresponding but opposite changes are made. The arms 42, 44 require a third set of recesses that corresponds to the recesses 46, 48, and a lower line of speed and the problems of evening the rods before they are laid onto the bed 60, are made somewhat more difficult. Short of having the furnace 2 itself either swivel or travel parallel to the bed 60 while heating the sucker rods which are being issued therefrom (either of which raises other problems on both the feed end and the delivery end), it is generally necessary for practical reasons to use an approach with appropriate ganged support means of the type shown, and because of the consideration indicated above, in a preferred manner of working, the number of sucker rods being normalized at one time is preferably, as illustrated, two.

In the embodiment illustrated above, the carriages 32 are advanced and retracted by means of a chain drive which is positively connected to sprockets that are located upon the common shaft 58 operated by the reversing motor 56. Those skilled in the art will perceive that various other means intended to insure that the carriages 32 advance and retract in unison may be substituted for the mechanism illustrated. If individual pneumatic or hydraulic cylinders associated with each of the carriages 32 could be relied upon to perform equally dependably when actuated, it is likely that a saving in equipment cost could be realized, but in view of the need for reliable, trouble-free, low-maintenance operation despite the somewhat adverse operating conditions, the particular means illustrated and discussed above is performed.

Although the invention has been shown and described in connection with certain specific embodiments, it will be readily apparent to those skilled in the art that various changes in form and arrangement of parts may be made to suit requirements without departing from the spirit and scope of the invention.

I claim as my invention:

1. A method for receiving from an electric induction normalizing furnace sucker rods heated thereby to a normalizing temperature and delivering said rods to a cooling bed while said rods are substantially continuously supported and rotated about their longitudinal axes, said method comprising the steps of advancing a sucker rod endwise through an electric induction furnace, heating the sucker rod to a normalizing temperature by operating said furnace at 3000 to 10,000 hertz and with a power of about 400 to 800 kilowatts, rotating the heated sucker rod to prevent sagging while advancing the sucker rod lengthwise from said furnace along successively-arranged sheaves each rotated by one of a plurality of spaced, parallel and driven shafts which extend lengthwise at an angle of 75° to 80° with respect to the route of travel of said sucker rod as it is delivered from said furnace, raising said rod by means of spaced support means which are located along said path of travel and are adapted for movement in unison in a direction transverse thereto, advancing said rod from a first position above said path of travel to a second position above a cooling bed while causing said rod to continue to rotate about its longitudinal axis, lowering said support means to deposit said sucker rod upon said cooling bed, and returning said support means to a position beneath said path of travel.

2. A method as defined in claim 1 wherein a pair of sucker rods in spaced, parallel, side-by-side relationship is advanced through said electric induction furnace, said furnace being adapted to normalize said pair of sucker rods simultaneously, and wherein said plurality of spaced support means comprises at least six sets of tracks located at spaced intervals with resect to said path of travel, and carriage means mounted upon each of said sets of tracks.

3. A method as defined in claim 2 wherein said pair of sucker rods is advanced along said path of travel at a rate of 10 to 20 feet per minute.

4. A method as defined in claim 3 wherein said pair of sucker rods is caused to abut against a stop member which evens them in respect to advancement along their respective paths of travel before they are conveyed to the cooling bed.

5. A method as defined in claim 4 wherein said method further comprises a step of automatically conveying said rods to said cooling bed by automatic means responsive to said stop means.

* * * * *